US006941286B1

(12) United States Patent
Foth

(10) Patent No.: US 6,941,286 B1
(45) Date of Patent: Sep. 6, 2005

(54) METHOD AND APPARATUS FOR PROVIDING REFUNDS IN A POSTAGE METERING SYSTEM

(75) Inventor: Thomas J. Foth, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/474,642

(22) Filed: Dec. 29, 1999

(51) Int. Cl.[7] ..... G07B 17/00
(52) U.S. Cl. ..... 705/403; 705/61; 705/404
(58) Field of Search ..... 705/30, 60, 61, 705/401, 403, 404

(56) References Cited

U.S. PATENT DOCUMENTS

| | | | | |
|---|---|---|---|---|
| 4,097,923 | A * | 6/1978 | Eckert et al. | 705/403 |
| 4,787,045 | A * | 11/1988 | Storace et al. | 705/60 |
| 4,813,802 | A | 3/1989 | Gilham et al. | 400/74 |
| 5,715,164 | A * | 2/1998 | Liechti et al. | 705/410 |
| 5,819,234 | A * | 10/1998 | Slavin et al. | 705/418 |
| 5,889,860 | A | 3/1999 | Eller et al. | 380/4 |
| 5,907,617 | A | 5/1999 | Ronning | 380/4 |
| 6,005,945 | A * | 12/1999 | Whitehouse | 380/51 |
| 6,050,486 | A * | 4/2000 | French et al. | 235/101 |
| 6,073,124 | A | 6/2000 | Krishman et al. | 705/59 |
| 6,687,684 | B1 | 2/2004 | Whitehouse et al. | 705/408 |

FOREIGN PATENT DOCUMENTS

| | | | |
|---|---|---|---|
| EP | 0741374 A2 | | 5/1996 |
| EP | 0782109 A2 | | 12/1996 |
| EP | 0814434 A2 | | 6/1997 |
| EP | 0927956 A2 | * | 7/1999 |
| EP | 1067483 A2 | * | 10/2001 |
| WO | WO97/00501 | | 1/1997 |

OTHER PUBLICATIONS

Unknown Author, Stamps.com To Pilor a New PC Postage Product, Aug. 2004, ePostal news, 4 Pages.*

* cited by examiner

*Primary Examiner*—John G. Weiss
*Assistant Examiner*—Richard Woo
(74) *Attorney, Agent, or Firm*—Steven J. Shapiro; Angelo N. Chaclas

(57) ABSTRACT

A method for facilitating refunds in a postage metering system includes the steps of receiving at a computer a request for a refund of a postage amount; using the computer for accessing a dispute account data base for identifying a dispute account associated with the request; determining, via the computer, if a value in the dispute account is acceptable for permitting a refund of the postage amount; and at times when the value is determined to be acceptable for permitting the refund of the postage amount, refunding the postage amount to a user of the postage meter. A system incorporates the method steps.

14 Claims, 3 Drawing Sheets

METHOD AND APPARATUS FOR PROVIDING REFUNDS IN A POSTAGE METERING SYSTEM

FIELD OF THE INVENTION

The instant invention relates to remote postage metering systems, and more particularly to postage metering systems having a dispute account refund mechanism.

BACKGROUND OF THE INVENTION

Postage meters are devices for dispensing value in the form of postage printed on a mailpiece such as an envelope. Postage meters of this type print and account for postage (value) dispensed by using a vault within the postage meter. The postage is included as part of a postage indicium that may also include a date and/or time associated with the printing of the indicium, a mailed from zip code, a postage meter identification number, and encrypted data that can be used by the cognizant postal authority to verify the authenticity of the printed indicium.

While postage meters have performed exceptionally well over the years, occasionally an indicium that is unreadable is printed even though the postage has been accounted for in the postage meter vault. This situation can occur, for example, where an ink supply associated with the printing device of the postage meter runs low thereby resulting in a poor printed image. When such a situation occurs, the user of the postage meter must save the mailpiece containing the unreadable indicium and bring it to the postal authority in order to obtain a refund for the value of the postage associated with the mailpiece. This process is obviously very time consuming and a big inconvenience to the user.

It is therefore desirable to provide a method and apparatus for a postage metering system that accommodates postage refund requests in a more efficient manner than the procedures outlined above.

SUMMARY OF THE INVENTION

It is an object of the invention to provide a method and apparatus for providing refunds in a postage metering system that overcomes the problems discussed above with regard to the refunding of postage value.

The above object is met by providing a method for facilitating refunds in a postage metering system including receiving at a computer a request for a refund of a postage amount; using the computer for accessing a dispute account data base for identifying a dispute account associated with the request; determining, via the computer, if a value in the dispute account is acceptable for permitting a refund of the postage amount; and at times when the value is determined to be acceptable for permitting the refund of the postage amount, refunding the postage amount to a user of the postage meter. A system incorporates the method steps.

Additional objects and advantages of the invention will be set forth in the description that follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. Furthermore, like reference numerals are used to describe similar components in the various Figures.

DETAILED DESCRIPTION OF THE PREFERRED EMBODIMENTS

Figure 1:
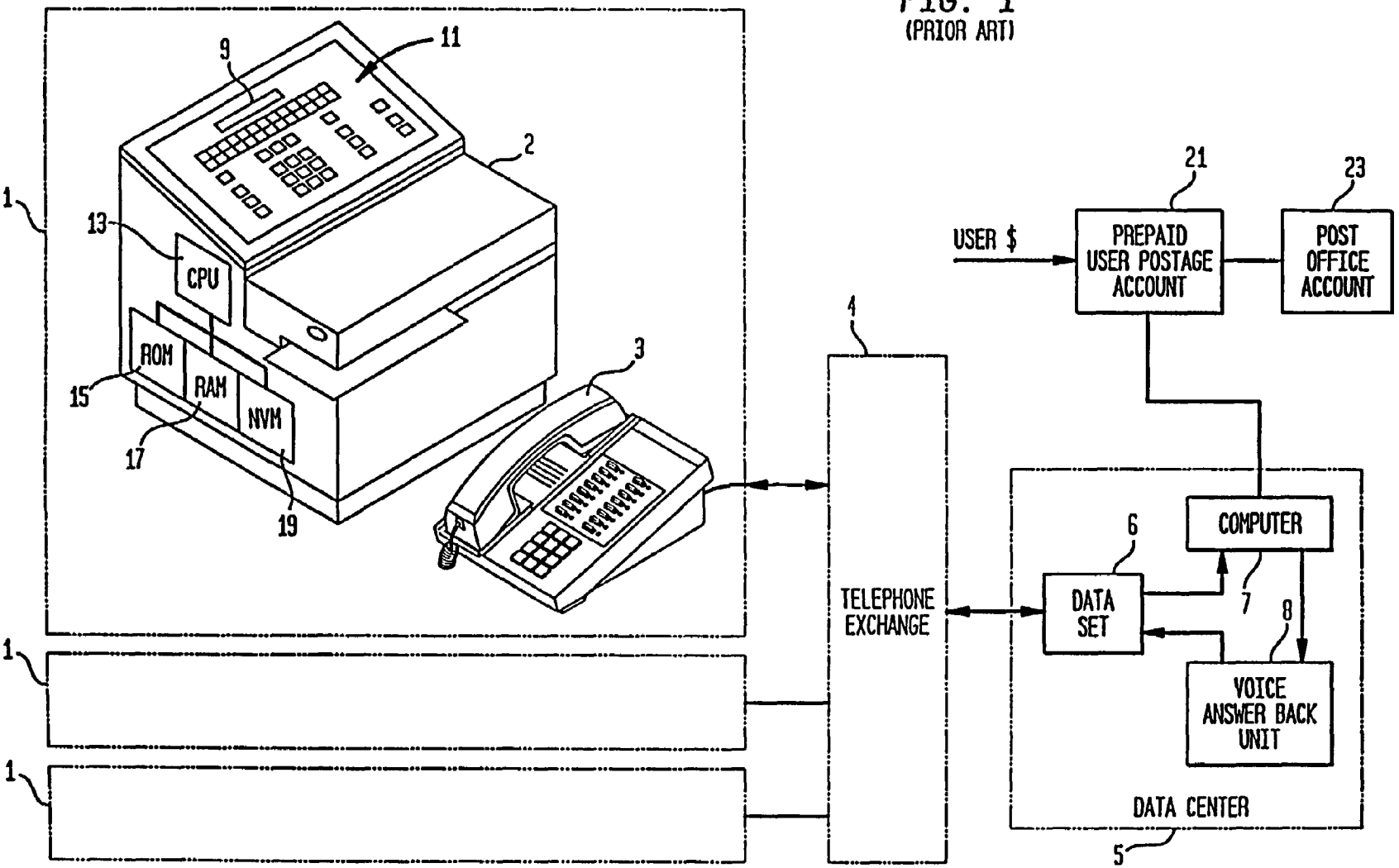
FIG. 1 (PRIOR ART)
FIG. 1 is a schematic block diagram of a first prior art postage metering system.

Referring to FIG. 1, a schematic block diagram of a conventional remote postage meter resetting system is shown. A plurality of blocks 1 represent remote postage meter stations capable of communicating with a data center 5. The remote postage meter stations 1 communicate with data center 5 via telephone exchange equipment generally indicated at 4. The transmitter-receiver at each remote station 1 is a conventional tone signaling telephone 3. Telephone 3 is used to establish two way communications between postage meter station 1 and data center 5.

Data center 5 includes a data set 6 of known construction which receives frequency encoded data input from telephone 3 of any of the remote postage meters stations 1 and transforms this input into a suitable machine language for use by a computer 7 of data center 5. Computer 7, in turn, controls in a conventional manner a known voice-answer back unit 8. Voice answer back unit 8 formulates voice responses for transmission back to the particular postage meter station 1, via the telephone exchange 4.

Each remote postage meter station 1 includes a known electronic postage meter 2. Postage meter 2 includes a display 9, a keyboard 11, a central processing unit 13 (or a plurality of CPU's operating together), a ROM 15, a RAM 17, and nonvolatile memory 19. The CPU 13 controls operation of the meter 2 including the keyboard 11 and display 9 so that information can be input by the user to the postage meter 2 via the keyboard 11 and displayed in display 9. Similarly, display 9 displays information or prompts from postage meter 2 to solicit input from or to communicate information to the postage meter user.

ROM 15 has stored therein the operating programs of the postage meter 2 which are executed by CPU 13, and RAM 17 acts as a temporary working memory utilized during program execution. NVM 19 typically has stored therein the postage accounting registers of the postage meter 2 which conventionally include: an ascending register which is indicative of the lifetime total amount of postage printed by the postage meter 2, a descending register which is indicative of the amount of available postage remaining in the postage meter 2, and a control sum register which represents the sum of the ascending and descending registers. Each of the aforementioned accounting register are changed, as required, when postage is dispensed from or added to the postage meter under the control of the CPU 13 operating in accordance with programming stored in ROM 15.

Postage is remotely funded into postage meter 2 by first telephoning data center 5 via telephone 3. The postage meter user provides the data center 5 with the meter serial number, the last readings of the ascending and descending registers, a user account number, and the amount of postage that is desired to be added to the postage meter 2. Computer 7 verifies the authenticity of the call in a known manner and communicates with a prepaid user postage account data base 21 to determine if the specified user account has enough prepaid funds therein to cover the amount of postage that is desired to be added to the postage meter 2. If sufficient funding exists in the user account, the user account is debited by the requested postage amount and a computer associated with data base 21 sends funds equivalent to the postage amount to be added to the postage meter 2 to a specified Post Office account 23. Computer 7 then formulates a resetting combination that is at least partially based on the meter serial number and the requested postage amount. This combination is transmitted to the user via the voice answer back unit 8, data set 6, telephone exchange 4, and telephone 3. Having received the combination code, the user unlocks the meter, keys in the desired postage to be added via the keyboard 11, and enters the combination. The meter 2 contains a program in ROM 15 that utilizes the entered desired postage refill amount and generates an internal combination based on that amount. If the internally generated combination and the entered combination are the same, the accounting registers are appropriately changed by CPU 13 thereby adding the desired postage to postage meter 2. If on the other hand, computer 7 determines that there is insufficient postage in the user account to cover the desired postage increase to postage meter 2, a response is received via telephone 3 advising that such is the case and terminating the transaction.

Figure 2:
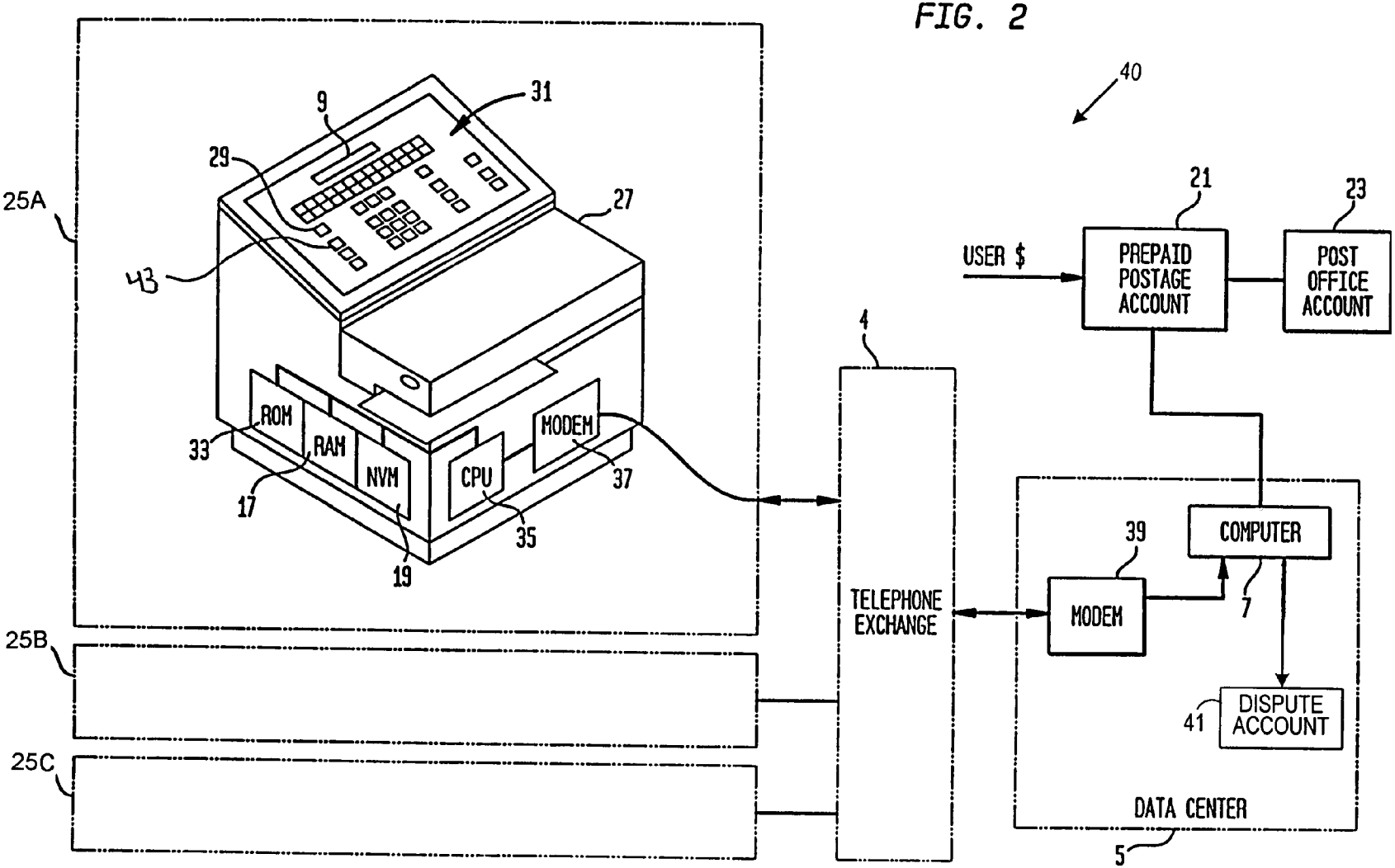
FIG. 2 is a schematic block diagram of a postage metering system incorporating the instant invention.

FIG. 2 shows a postage meter resetting system 40 which is very similar to the system of FIG. 1 except that it is more fully automated. The system 40 only requires the user to establish communication with the data center 5 via the plurality of remote postage meter stations 25A, 25B, and 25C and to provide the data center 5 with the desired postage amount to be added to postage meter 27. The remaining downloading of data to data center 5, downloading of the combination from the data center 5 to meter 27, the internal generation of the combination by the meter 27, the comparison of the combinations, and the subsequent addition of postage by changing accounting register values are automatically accomplished under the control of CPU 35.

In operation, the user presses a designated button 29 of keyboard 31, which button 29 indicates that a remote postage refill is desired. Programming in ROM 33 causes CPU 35 to prompt the user via display 9 to enter, via keyboard 31, the amount of postage desired. Once the user responds, CPU 35 activates a modem 37 that automatically dials data center 5 and establishes communication therewith via a modem 39 at data center 5. CPU 35, via modems 37, 39 and telephone exchange 4 automatically provides the necessary register readings, the meter serial number, the prestored user account number, and the amount of postage desired to computer 7. Computer 7 then authenticates the call and communicates with prepaid postage account 21 to determine whether or not sufficient funds exist in the specified user account to cover the desired postage to be added to postage meter 27. If sufficient funds are available, debiting of the user account and the sending of postage funds to the post office account 23 are accomplished as previously discussed in connection with FIG. 1. However, in the system of FIG. 2, the combination code generated by computer 7 is sent directly to the CPU 35 from computer 7 via modems 39,37 and telephone exchange 4. CPU 35 then generates a combination code as previously discussed in connection with CPU 13 of FIG. 1, compares the generated code to the received code, and adds postage to the meter by changing the accounting registers if the codes match. Thus, the system of FIG. 2 requires less user input to accomplish the adding of postage to postage meter 27.

As previously discussed, it is possible that the ink supply associated with a printing device (not shown) of postage meter 27 may run low on ink such that an unreadable postage indicium is printed on a mailpiece. The inventive postage metering system 40 provides an effective mechanism for accommodating refund requests associated with the unreadable indicium through the use of a dispute account database 41. The dispute account data base 41 includes a plurality of dispute accounts, each of which is associated with a corresponding one of the user accounts of the prepaid postage account data base 21. In one embodiment, each dispute account is initially set at a predetermined threshold value and is decremented each time a refund request associated with a particular dispute account is honored, as discussed in more detail below.

Figure 3:
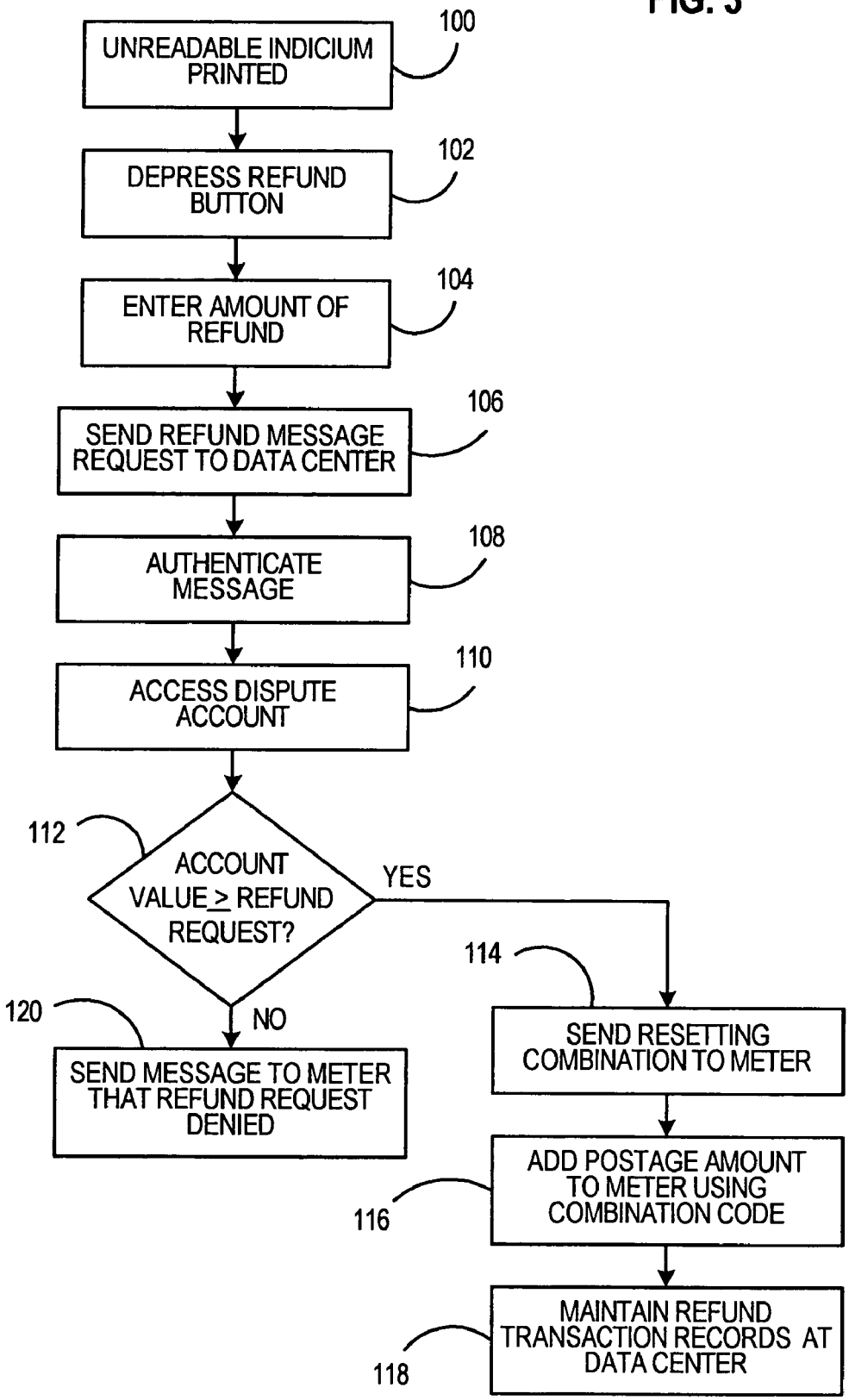
FIG. 3 is a flowchart describing the operation of the inventive postage refund process.

Referring to FIG. 3, a more detailed explanation of the inventive refund process will be described. At step 100, an unreadable postage indicium is printed by the postage meter 27 of remote postage meter station 25A. Since the user of the postage meter 27 desires a refund for the value associated with the unreadable indicium, the user can depress a refund button 43 that is provided on the keyboard 31 (step 102). The CPU 35, executing code in ROM 33, causes display 9 to prompt the user to enter, via keyboard 33, the amount of the requested refund (step 104). Once the refund amount has been entered, the CPU 35, via the modem 37, automatically dials into the data center 5 and sends a refund request message to computer 7 (step 106). The refund request message includes an indicator that identifies it as a refund request and also includes the meter serial number, the last readings of the ascending and descending registers, the user prepaid account number, and the amount of the refund request. The authenticity of the refund request message is verified in the same known manner used for postage refill requests (step 108). Upon verification, computer 7 communicates with dispute account data base 41 to obtain access to the corresponding dispute account associated with the specifically identified user prepaid postage account of prepaid postage account data base 21 (step 110). Computer 7 then ascertains if the current value in the user's dispute account is greater than or equal to the amount of the refund request (step 112). If the answer is "YES", the computer 7 treats the refund request in a manner similar to a postage refill request by generating and sending a resetting combination code to postage meter 27 (step 114). Postage meter 27 uses the combination code in the manner previously described with respect to postage refills in adjusting the accounting registers in NVM 19 to add the amount of the refund request (step 116). The computer 7 also keeps a record of all user refunds that have been given or denied and provides this information to the postal service for use in reconciling the amount of prepaid postage received from each user and the readings of the accounting registers in NVM 19 (step 118).

Returning to the inquiry at step 112, if the answer is "NO", computer 7 sends a message to postage meter 27 (displayed on display 9) advising the user that their dispute account has been exceeded such that a refund cannot be given (step 120). However, the user is advised that they can still bring the unreadable mailpiece to a postal facility to obtain a refund.

As previously discussed, each dispute account starts at a threshold value and is decremented by the amount of each refund provided to that user. When the decremented value in the dispute account is less than the amount of the refund request, a refund will not be given. Alternatively, the dispute account can be decremented until it is less than or equal to zero before a refund request is denied. Furthermore, instead of a descending register dispute account, an ascending register can be utilized such that when an upper threshold value of refunds has been met or exceeded the refund request is denied.

While the above system described the refund amount as being added to the accounting circuitry in NVM 19, alternatively the data center 5, via computer 7, can simply transfer the requested refund amount to the user's prepaid postage account 21 and send a message to the postage meter 27 that such deposit has been made. Furthermore, postage meter 27 can be programmed to print a deposit receipt for the refund request. The deposit receipt can be the message sent from the computer 7 to postage meter 27. The message can be signed with a private key of the data center 5 or encrypted at the data center 5. This would allow the printed receipt to be verified if it were ever needed by the user to prove that a refund was supposed to be credited to either their postage meter accounting circuitry or their prepaid postage account 21.

The above described dispute account mechanism provides a significant advantage to the postage meter user in that it permits a refund to be obtained without providing actual proof of the unreadable mailpiece. Thus, legitimate postage meter users who occasionally have a meter problem can easily be provided with a refund for lost postage. On the other hand, the threshold value set in the dispute account places a limit on the total amount of refunds that will be provided to a user without question. Thus, if an unscrupulous user attempts to abuse the automatic refund system they will be prevented from doing so since once they exceed the threshold refund value they will have to provide proof for all future refund requests.

The dispute account system described above can also include a counter which counts the number of times each individual user requests a refund so that the automatic refund mechanism can be turned off if a particular users number of uses of the refund system exceeds a predetermined number. Moreover, since the data center 5 has a clock capability, all of the dispute account threshold values or numbers can be associated with a period of time so that the threshold values/numbers can be automatically reset to an initial value if they have not been exceeded for the designated period of time.

Additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims. For example, while the preferred embodiment has been shown in the context of one type of postage meter it is also applicable to PC meters and virtual meters. The PC meter, which is known in the art, includes a portable vault (postage accounting circuitry) that interfaces directly with a personal computer. In the virtual meter each postage meter vault resides at a central server and each user has client software on their personal computer which permits them to interface with the server to dispense postage at the personal computer while accounting for the postage dispensed at the server vault. Both the PC meter and virtual meters would interface with the data center 5 in the same manner discussed above, although the virtual meter vault server could be co-located at the data center. It is further understood that the communications between the various components of the postage metering system described herein can take place over the Internet or any other known or future communication vehicles.

Additionally, the term postage meter also includes other similar meters that dispense an indication of value such as parcel post meters and tax stamp machines. Moreover, while the embodiment described above concerns a postage meter having prepaid funds, the instant invention is applicable to post paid fund systems. In post-paid systems the meter accounts for the funds dispensed and the postal authority receives payment subsequent to the postage transactions.

Furthermore, when a refund is provided in the inventive system it can alternatively can be sent regular mail or electronically to any account designated by the user.

In yet another embodiment, the dispute account 41 can reside in the postage meter 27 rather than at the data center 5. In this scenario the refund process works the same except that it is done offline from the data center through programming and a dispute account in postage meter 27. Subsequently, when postage meter 27 next contacts the data center 5 for either an inspection requirement or a funds refill. At this point in time, the meter on its own or in response to a query from the data center 5 would request reconciliation of the dispute account. Based on the dispute account reading, the data center 5 could add a refill amount to the meter vault to compensate for the requested refund(s) or provide the refund in some other manner. Moreover the postage meter 27 would maintain a refund transaction record which would be sent to the data center 5. In an alternative embodiment, the entire refund process could be handled within the meter with the refund data being provided to the data center 5 upon communication therewith for auditing purposes.

Finally, while the preferred embodiment required the user to enter the refund amount into the postage meter 27, the postage meter 27 could be designed to display after each printed postage value a query as to whether a refund is needed. If the answer is yes, the postage meter knowing the last transaction would automatically supply the amount of the refund request,

What is claimed is:

1. A method for facilitating refunds in a postage metering system, the method comprising the steps of:

receiving at a computer a request for a refund of a postage amount, the request being associated with a postage meter;

using the computer for accessing a dispute account database for identifying a dispute account having a value therein that is indicative of a level of refund activity attributable to the postage meter, the dispute account being associated with the request;

determining, via the computer, if the value in the dispute account is acceptable for permitting a refund of the postage amount; and at times when the value is determined to be acceptable for permitting the refund of the postage amount, refunding the postage amount to a user of the postage meter by sending enabling data from the computer to the postage meter, the enabling data useable by the postage meter to add the postage amount to a vault of the postage meter.

2. A method as recited in claim 1, further comprising adjusting the value in the dispute account to account for the postage amount refunded.

3. A method as recited in claim 1, wherein at times when the value is determined to be not acceptable, sending a message for one of printing and display at the postage meter, the message advising that the request for a refund has been denied.

4. A method as recited in claim 1, further comprising sending the request from the postage meter to the computer.

5. A method as recited in claim 1, wherein the postage meter is remotely located from the computer.

6. A method as recited in claim 1, further comprising maintaining a transaction record of the refunding at the computer.

7. A method as recited in claim 1, wherein the postage amount correlates to a postage value previously dispensed by the postage meter.

8. A postage metering system comprising:

a postage meter having a vault that accounts for postage dispensed by the postage meter and a processor for controlling operation of the postage meter;

a data center in communication with the postage meter, the data center having a central processing unit and a dispute account database, the dispute account database having a dispute account having a value therein that is indicative of a level of refund activity attributable to the postage meter, the dispute account being associated with the postage meter;

means for permitting communication between the postage meter and the data center;

wherein at times when the data center receives a request for a refund of a postage amount for the postage meter the central processing unit determines if the value in the dispute account is acceptable for permitting a refund of the postage amount and if it is the central processing unit refunds the postage amount to a user of the postage meter by sending enabling data useable by the processor for adding the postage amount to the postage meter vault.

9. A postage metering system as recited in claim 8, wherein the postage meter further includes a printing device that prints a receipt of the postage amount refunded.

10. A postage metering system as recited in claim 8, wherein the postage meter sends the request to the data center and the postage amount correlates to a postage value previously dispensed by the postage meter.

11. A postage metering system as recited in claim 8, wherein the postage meter is remotely located from the data center.

12. A method for facilitating refunds in a postage meter, the method comprising the steps of:

receiving at the postage meter a request for a refund of a postage amount;

accessing a dispute account in the postage meter to determine if a value in the dispute account is acceptable for permitting a refund of the postage amount, the value indicative of a level of refund activity attributable to the postage meter; and at times when the value is determined to be acceptable for permitting the refund of the postage amount, refunding the postage amount to a user of the postage meter by adding the postage amount to a vault of the postage meter.

13. A method as recited in claim 12, wherein at times when the postage meter communicates with a remote data center sending a message from the postage meter to the data center to initiate the refunding of the postage amount to the user.

14. A postage meter comprising:

a processor that controls operation of the postage meter;

a vault that accounts for postage dispensed by the postage meter;

a dispute account having a value therein, the value indicative of a level of refund activity attributable to the meter;

wherein at times when the postage meter receives a request for a refund of a postage amount the processor determines if the value in the dispute account is acceptable for permitting a refund of the postage amount and if it is the processor refunds the postage amount to a user of the postage meter by adding the postage amount to the vault.

* * * * *